US009746220B2

(12) United States Patent
Molavi

(10) Patent No.: US 9,746,220 B2
(45) Date of Patent: Aug. 29, 2017

(54) REFRIGERANT VAPORIZER

(75) Inventor: Anthony S. Molavi, Mooresville, NC (US)

(73) Assignee: Carrier Corporation, Jupiter, FL (US)

( * ) Notice: Subject to any disclaimer, the term of this patent is extended or adjusted under 35 U.S.C. 154(b) by 623 days.

(21) Appl. No.: 14/233,180

(22) PCT Filed: Jul. 27, 2012

(86) PCT No.: PCT/US2012/048562
§ 371 (c)(1),
(2), (4) Date: Jan. 16, 2014

(87) PCT Pub. No.: WO2013/032611
PCT Pub. Date: Mar. 7, 2013

(65) Prior Publication Data

US 2014/0174112 A1 Jun. 26, 2014

Related U.S. Application Data

(60) Provisional application No. 61/527,787, filed on Aug. 26, 2011.

(51) Int. Cl.
*F25B 31/00* (2006.01)
*F25B 43/02* (2006.01)

(52) U.S. Cl.
CPC ..... *F25B 43/02* (2013.01); *F25B 31/004* (2013.01); *F25B 2400/01* (2013.01); *F25B 2400/05* (2013.01)

(58) Field of Classification Search
CPC ..... F25B 43/02; F25B 43/006; F25B 2400/23
See application file for complete search history.

(56) References Cited

U.S. PATENT DOCUMENTS 1,458,899 A * 6/1923 Wolfe ..... F25B 39/04 62/467
3,822,567 A * 7/1974 Kasahara ..... F25B 31/004 62/470

(Continued)

FOREIGN PATENT DOCUMENTS

CN 1289895 A 4/2001
CN 201096430 Y 8/2008

(Continued)

OTHER PUBLICATIONS

International Search Report and Written Opinion for PCT/US2012/048562, dated Feb. 26, 2013.

(Continued)

*Primary Examiner* — Ljiljana Ciric
*Assistant Examiner* — Alexis Cox
(74) *Attorney, Agent, or Firm* — Bachman & LaPointe, P.C.

(57) ABSTRACT

A vaporizer has: an inlet (72); an oil outlet (90; 94); a vent (120); a hot gas inlet (132); and a cooled gas outlet (134). A gas flowpath (130) extends from the hot gas inlet to the cooled gas outlet. A vaporizer chamber (192) is downstream of the inlet along a primary flowpath. A gas conduit (220) is along the gas flowpath in heat exchange relation with the primary flowpath. A sump (194) is below the vaporizer chamber. A housing (180) encloses the sump and the vaporizer chamber. A passageway extends from the vaporizer chamber to the sump.

16 Claims, 6 Drawing Sheets

(56) References Cited

U.S. PATENT DOCUMENTS 4,282,717 A * 8/1981 Bonar, II ..... F25B 43/02 62/113
4,690,759 A * 9/1987 Mandy ..... B01D 45/14 210/304
4,906,264 A * 3/1990 Szymaszek ..... B01D 17/045 210/304
5,347,821 A 9/1994 Oltman et al.
5,724,832 A * 3/1998 Little ..... B01D 8/00 62/114
6,182,467 B1 2/2001 Zhong et al.
6,672,102 B1 * 1/2004 Huenniger ..... F25B 1/047 62/472
9,032,754 B2 * 5/2015 Love ..... F25B 1/047 62/468
2004/0065110 A1 * 4/2004 Barratt ..... B01D 45/06 62/471
2006/0123833 A1 * 6/2006 Flanigan ..... F25B 43/02 62/470
2008/0210601 A1 * 9/2008 Shoulders ..... F25B 31/004 208/184
2012/0125040 A1 * 5/2012 Matsui ..... B01D 39/06 62/470
2012/0318370 A1 * 12/2012 Verver ..... B63C 7/006 137/13
2013/0091891 A1 * 4/2013 Hinde ..... F25B 43/02 62/470
2016/0010907 A1 * 1/2016 Ali ..... F25B 43/02 62/84
2016/0123640 A1 * 5/2016 Kil ..... F25B 13/00 62/470

FOREIGN PATENT DOCUMENTS

CN 101443605 A 5/2009
CN 100529603 C 8/2009
WO 2007/008193 A2 1/2007

OTHER PUBLICATIONS

Evergreen® 23XRV High-Efficiency Variable Speed Screw Chiller with Foxfire™ Compression Technology and PIC III Controls 50/60 Hz HFC-134a, Start-Up, Operation and Maintenance Instructions, Catalog No. 04-53230001-01, 2011, Carrier Corporation, Syracuse, New York.

Chinese Office Action for Chinese Patent Application No. 201280041604.X, dated Jul. 8, 2015.

* cited by examiner 134
186
230
190-3
170
227
224
72
190
130
220
190-1
190-2
310
292
294
262
80
300
154
290
132
228
222
190-4
226
120
300

134
72
95
300
94
194
192
310
310
292
154
290
300
132
120
300

120
132
300
80
290
194
192
310
94
72
134
95
170

REFRIGERANT VAPORIZER

CROSS-REFERENCE TO RELATED APPLICATIONS

Benefit is claimed of U.S. patent application Ser. No. 61/527,787, filed Aug. 26, 2011, and entitled "Refrigerant Vaporizer", the disclosure of which is incorporated by reference herein in its entirety as if set forth at length.

BACKGROUND

The disclosure relates to refrigeration. More particularly, the disclosure relates to oil reclaim vaporizers for chiller systems.

In refrigeration systems such as chillers, it is known to use a vaporizer to separate refrigerant from a refrigerant/lubricant (oil) mixture. U.S. Pat. No. 6,672,102 of Huenniger et al. discloses a system wherein a vaporizer receives a refrigerant/lubricant mixture flow drained from an evaporator. The flow is mostly oil and it is desired to remove the refrigerant before returning the oil to lubricate the compressor. The flow is placed in heat exchange relation with a hot gas bypass flow passed from the compressor discharge to the evaporator. Vaporized refrigerant is passed to compressor suction and oil is drained to an oil sump to be returned to a compressor oil return port for lubrication (e.g., of bearings and rotors).

SUMMARY

One aspect of the disclosure involves a vaporizer comprising: an inlet; an oil outlet; a vent; a hot gas inlet; and a cooled gas outlet. A gas flowpath extends from the hot gas inlet to the cooled gas outlet. A vaporizer chamber is downstream of the inlet along a primary flowpath. A gas conduit is along the gas flowpath in heat exchange relation with the primary flowpath. A sump is below the vaporizer chamber. A housing encloses the sump and the vaporizer chamber. A passageway extends from the vaporizer chamber to the sump.

Other aspects involve a refrigeration system including such a vaporizer.

Additional aspects involve methods for operating the vaporizer or refrigeration system. A gas flow is passed into the hot gas inlet and out the cooled gas outlet. A refrigerant and oil flow is passed into the inlet. Heat is transferred from the gas flow to the refrigerant and oil flow. The refrigerant and oil flow is separated so that a refrigerant-rich (e.g., relative to the refrigerant and oil flow entering the inlet) portion exit the vents and an oil-rich portion exits the oil outlet.

The vaporizer may comprise a two-stage heating element and the method may comprise, when the compressor is on, running (controlled by a controller) in each of three modes: both stages off; one stage on; and both stages on. Running with both stages off may be when either condenser refrigerant temperature is greater than a first threshold condenser refrigerant temperature or oil temperature is greater than a first oil temperature threshold. Running with only one stage on may be when either: condenser refrigerant temperature is less than a second threshold condenser refrigerant temperature which is lower than the first threshold condenser refrigerant temperature and motor speed is lower than a speed threshold; or oil temperature is either less than a second oil temperature threshold, lower than the first oil temperature threshold, or less than the saturated suction temperature plus a predefined increment. Running with both stages on may be when the oil temperature is both less than the second oil temperature threshold and less than the saturated suction temperature plus the predefined increment.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
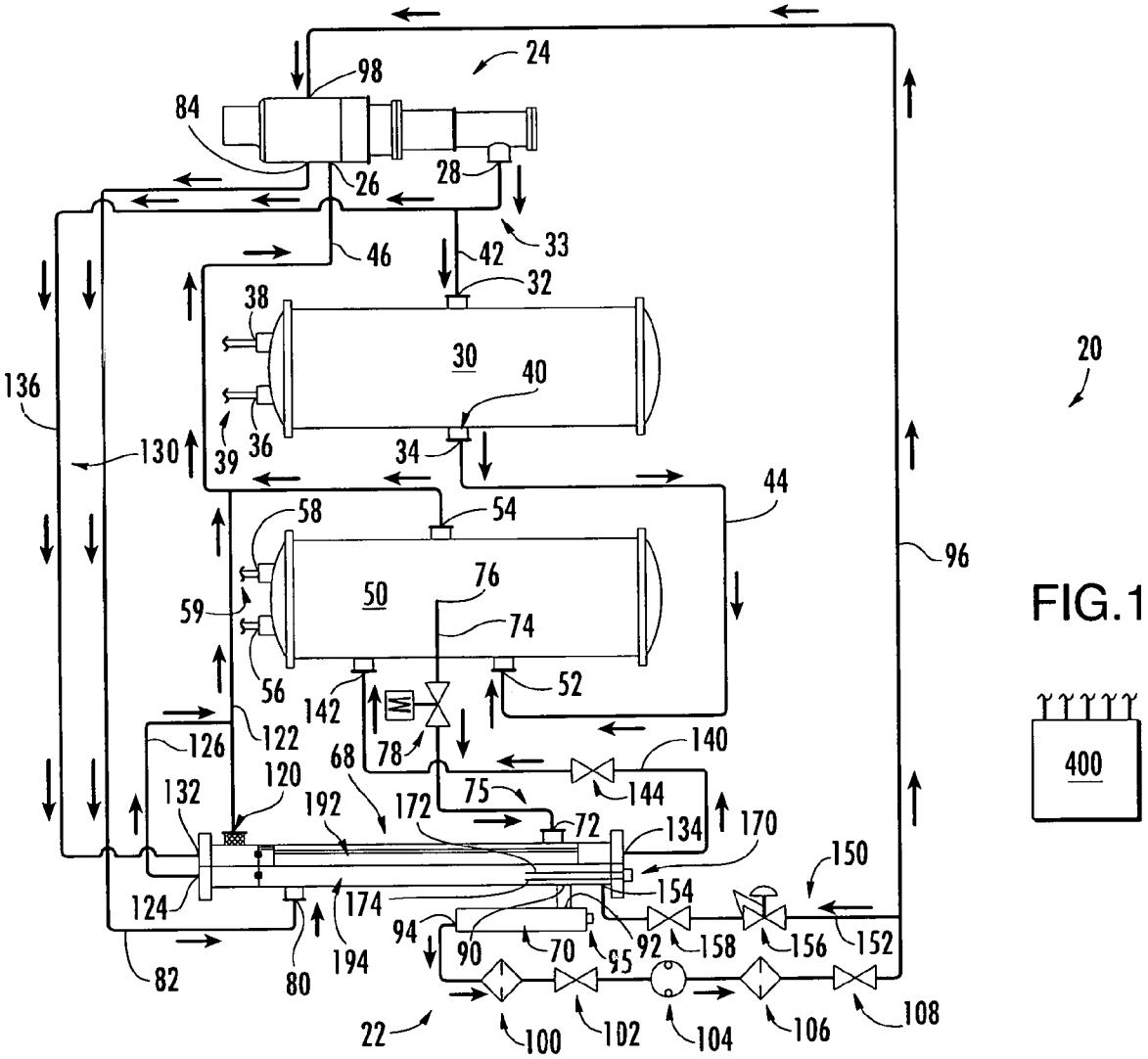
FIG. 1 is a partially schematic view of a chiller system.
Figure 2:
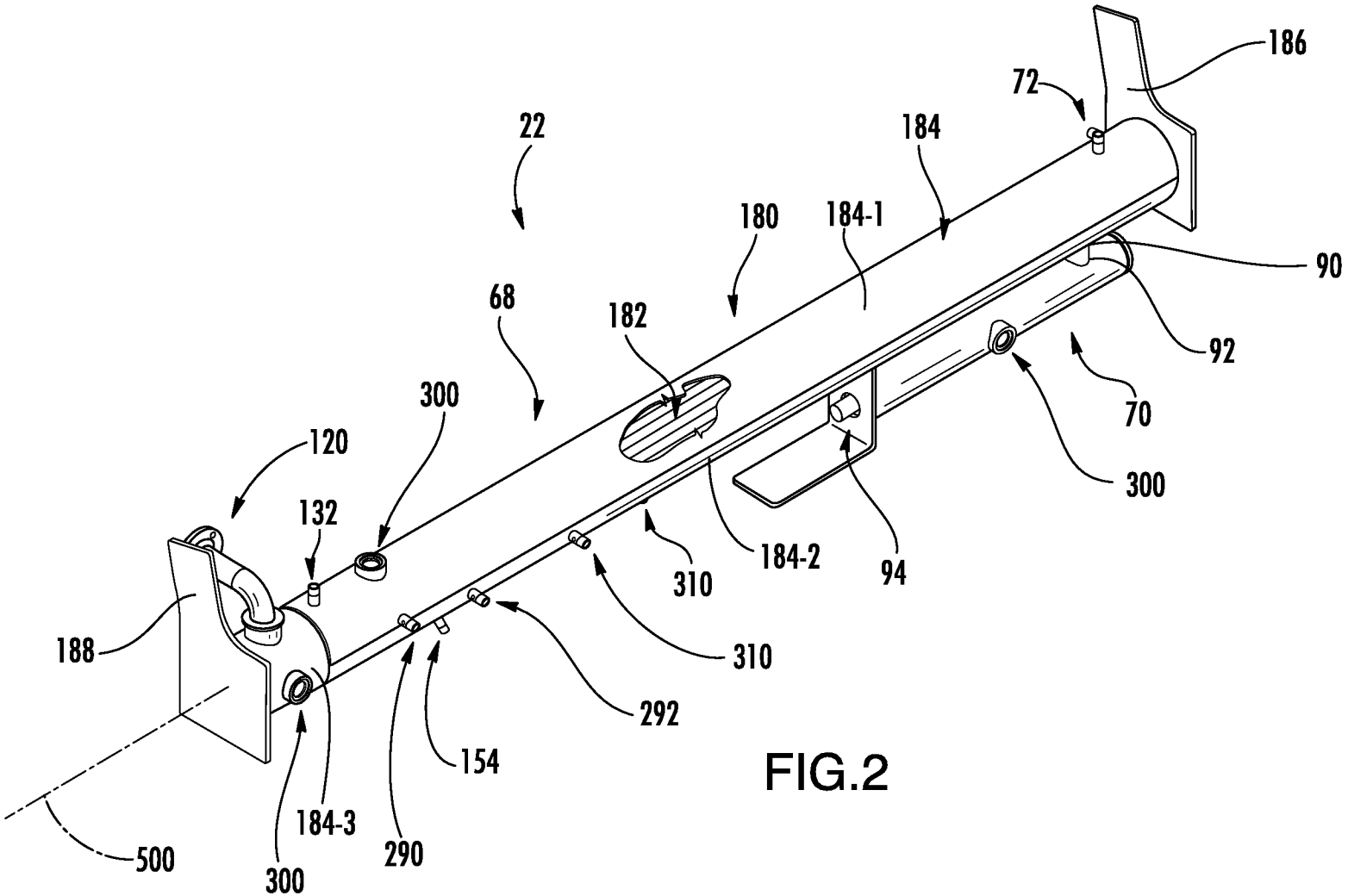
FIG. 2 is a view of a vaporizer system within the chiller system of FIG. 1.

FIG. 1 shows a chiller system 20 including a vaporizer system 22. The system 20 includes a compressor 24 having a suction port 26 and a discharge port 28. An exemplary compressor 24 is a screw compressor having a hermetic electric motor (not shown) within a case. Alternative compressors are centrifugal compressors, scroll compressors, or reciprocating compressors. A condenser 30 has a gas/vapor inlet port 32 downstream of the discharge port 28 along a refrigerant primary flowpath 33. In operation, the compressor compresses refrigerant to drive a recirculating flow of refrigerant along the refrigerant primary flowpath 33 and branches there off. The condenser has a liquid outlet 34 downstream along the refrigerant primary flowpath. The exemplary condenser is a liquid-cooled (e.g., water-cooled) compressor having a water inlet 36 and a water outlet 38 for water flow passing along a water flowpath 39 through a tube bundle (not shown) in heat transfer relation with the refrigerant primary flow to absorb heat from the refrigerant to cool and condense the refrigerant. The condenser may be of any appropriate existing or yet-developed type. The exemplary condenser unit includes a float valve 40 which acts as an expansion device. Alternative implementations may include alternative expansion devices. A controller 400 (e.g., microprocessor based) may control operation of various components of the system 20 and may receive input from various sensors and user input devices.

Downstream of the condenser along the refrigerant primary flowpath 33 is an evaporator 50. The exemplary evaporator has a refrigerant inlet 52 and a refrigerant outlet 54 along the primary flowpath. The exemplary evaporator is used to chill a second heat transfer liquid (e.g., water). Accordingly, the exemplary evaporator 50 has a water inlet 56 and a water outlet 58 along a water flowpath 59. Refrigerant passing along the primary flowpath 33 through the evaporator is in heat exchange relation with the water (e.g., the water flowpath 59 passes through a tube bundle (not shown) over which the refrigerant flows) to absorb heat from the water. As with the condenser, the evaporator may represent any appropriate existing or yet-developed configuration. Additional evaporator ports cooperating with the vaporizer system 22 are discussed below.

There are several additional flowpaths through the vaporizer system 22 for passing refrigerant and/or oil.

The exemplary vaporizer system 22 includes a main vaporizer unit 68 and an oil reservoir 70. Depending upon context, the term "vaporizer" may designate either the system 22 or the unit 68 or the vaporizer chamber discussed below.

The exemplary conduits or lines along the refrigerant primary flowpath 33 are a discharge line 42 between the discharge port 28 and the condenser inlet 32, an intermediate line/conduit 44 between the condenser outlet 34 and the evaporator inlet 52, and a suction line 46 between the evaporator outlet 54 and the suction point 26.

The exemplary system 22 and unit 68 have an inlet 72 (a main inlet) for receiving a refrigerant/oil mixture. The exemplary inlet 72 receives the mixture from the evaporator. The exemplary refrigerant/oil mixture passes along/through a skim line/conduit 74 along a mixture inlet flowpath 75 from a skim port (or group of ports) 76 on the evaporator. A modulating valve 78 may be located along the line 74 and controlled so as to control the amount of oil needed (e.g., based upon sensed operating parameters the controller modulates the valve). The system 22 and unit 68 share a second inlet port (inlet) 80 which receives an oil drain flow from the compressor. The oil drain flow passes along/through a drain line/conduit 82 from a drain port 84 of the compressor. The exemplary unit 68 has an oil outlet 90 coupled to an oil inlet port (inlet) 92 of the reservoir 70. The reservoir 70 and system 22 share an oil outlet port (outlet) 94. FIG. 1 further shows an oil charging port/fitting 95 on the reservoir for easy addition of oil to the system. The oil outlet 94 is coupled via an oil return line/conduit 96 to an oil return port 98 of the compressor. In series from upstream to downstream along the exemplary line/conduit 96 are a first filter 100, a shutoff valve 102, a pump 104, a second filter 106, and a second shutoff valve 108.

The exemplary system 22 and unit 68 share one or more vapor outlets. As is discussed further below, a first vapor outlet is shown as 120 and is coupled via a vapor line/conduit 122 to the compressor suction port 26 (e.g., the line/conduit 122 merges with the suction line 46). A second vapor outlet port (outlet) 124 is also shown which (as discussed below) forms a sump vapor outlet. Alternative implementations may combine such vapor outlets. The exemplary outlet 124 is coupled via a branch line/conduit 126 which merges with the line/conduit 122. An exemplary alternative involves internally routing the line/conduit 122.

To supply heat to the vaporizer, a hot gas bypass flowpath 130 passes through the unit 68. Along the hot gas bypass flowpath 130, the system 22 and unit 68 share a hot gas inlet port (inlet) 132 and a cooled gas outlet port (outlet) 134. The exemplary inlet 132 is connected via an upstream leg 136 of a bypass conduit to the discharge line 42. Alternative implementations may draw the hot gas bypass flow from an upstream portion of the condenser. The exemplary port 134 returns the cooled gas to the evaporator. The exemplary port 134 is coupled by a line/conduit 140 to a vaporizer vapor return port 142 of the evaporator. An exemplary orifice and/or valve 144 is positioned along the line 140 so as to limit the mass flow return to the evaporator. Although an example is a simple fixed orifice alone, this may be replaced by the combination of a fixed orifice and a separate shutoff valve or via a combined orifice/valve.

Figure 8:
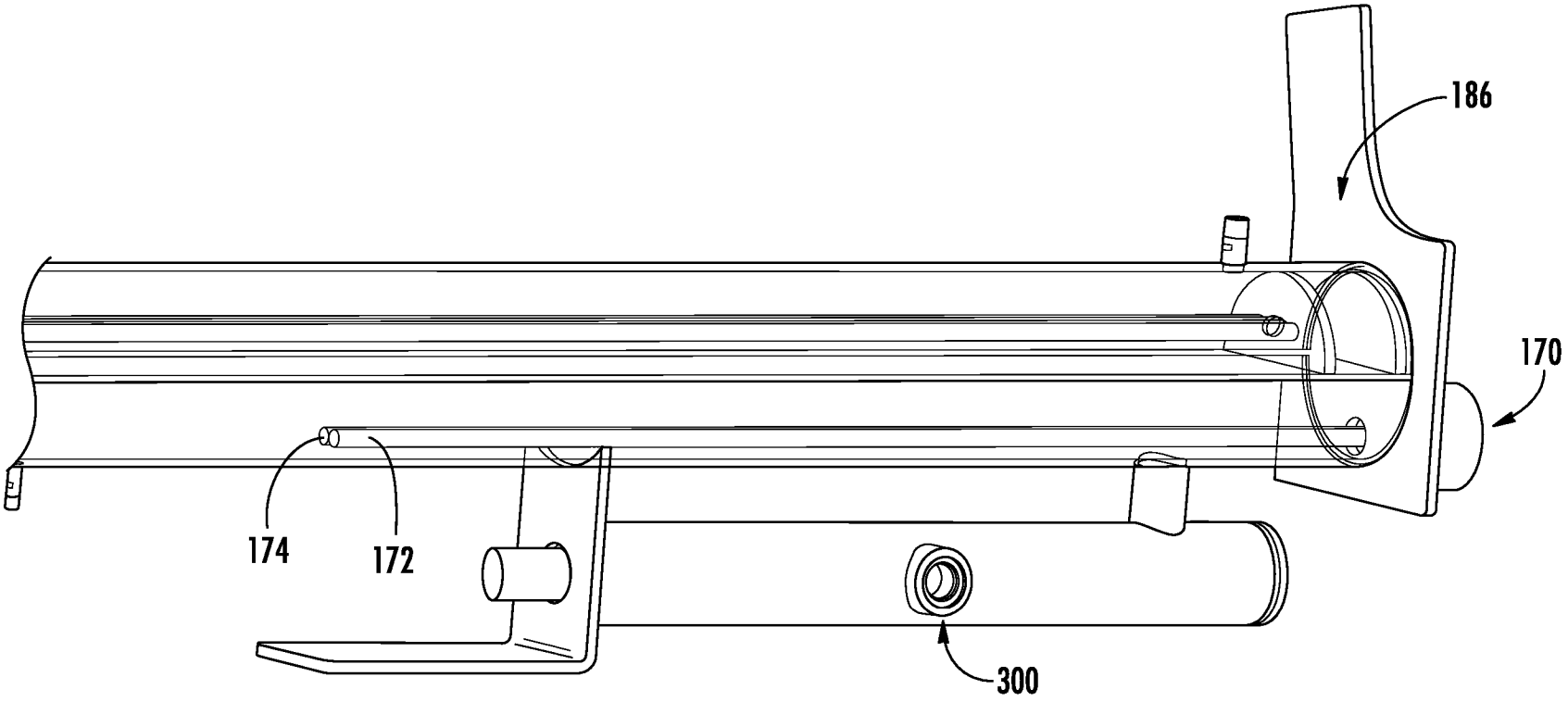
FIG. 8 is an enlarged partial view of the vaporizer of FIG. 3.

As is discussed further below, an additional refrigerant branch is a pressure reference branch 150 having a conduit 152 branching from the oil return conduit 96 and extending to a reference pressure port 154 shared by the unit 68 and system 22. Along the conduit 152 are an exemplary pressure regulating valve 156 and shutoff valve 158. In normal operation, the pressure regulating valve 156 serves to maintain an internal pressure of the system 22 and unit 68 at a pressure that prevents excess oil delivery back to the compressor bearing/rotor/etc. (e.g., an exemplary pressure being 21-29 psid (145-200 kPad)). FIGS. 1 and 8 further show a supplemental heater 170 (e.g., an electric heater) having one or more heating elements (e.g., a pair of elements being separately operable first element/stage 172 and second element/stage 174) positioned to heat oil in the system 22. The exemplary heater is an immersion-type stainless steel firebar of 3000 watts (1500 watts per stage) and a working pressure of 450 psi (3103 kPa). A yet higher wattage may be appropriate for ice duty (low evaporating temperature) applications.

FIGS. 2-8 show further details of the system 22.

The exemplary unit 68 has a housing or shell 180 surrounding an interior space 182 (subdivided as discussed further below). The exemplary shell 180 is formed as a generally elongate circular cylinder (e.g., having a metal (e.g., carbon steel) sidewall 184 and metallic (e.g., carbon steel) end members (e.g., first and second endplates 186 and 188) secured to the sidewall (e.g., via welding or bolting to flanges (not shown)). The various ports may be defined at respective fittings along the housing in accordance with standard engineering principles for refrigeration components. The exemplary sidewall 184 is segmented to facilitate assembly (e.g., segmented via cutting from tube stock and then assembled via welding). The exemplary shell includes a main upper portion 184-1 and a main lower portion 184-2. Each of these is approximately 180° about a centerline 500. The exemplary embodiment further includes a full circumference end portion 184-3 near the second end.

Figures 3, 4, 5:
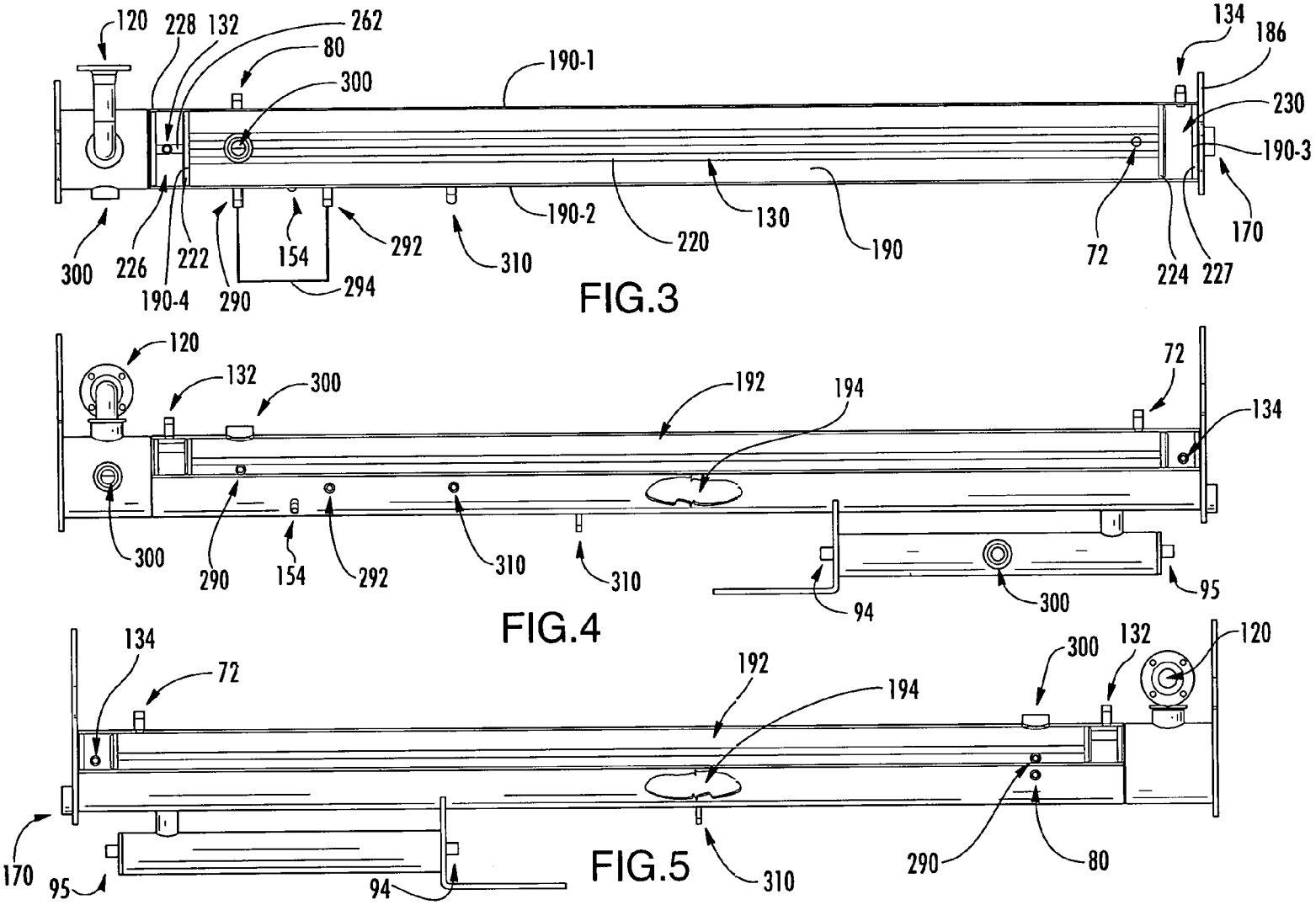
FIG. 3 is a top view of the vaporizer system of FIG. 2 with housing upper half and associated fittings rendered transparent.
FIG. 4 is a front view of the vaporizer of FIG. 3.
FIG. 5 is a rear view of the vaporizer of FIG. 3.
Figure 6:
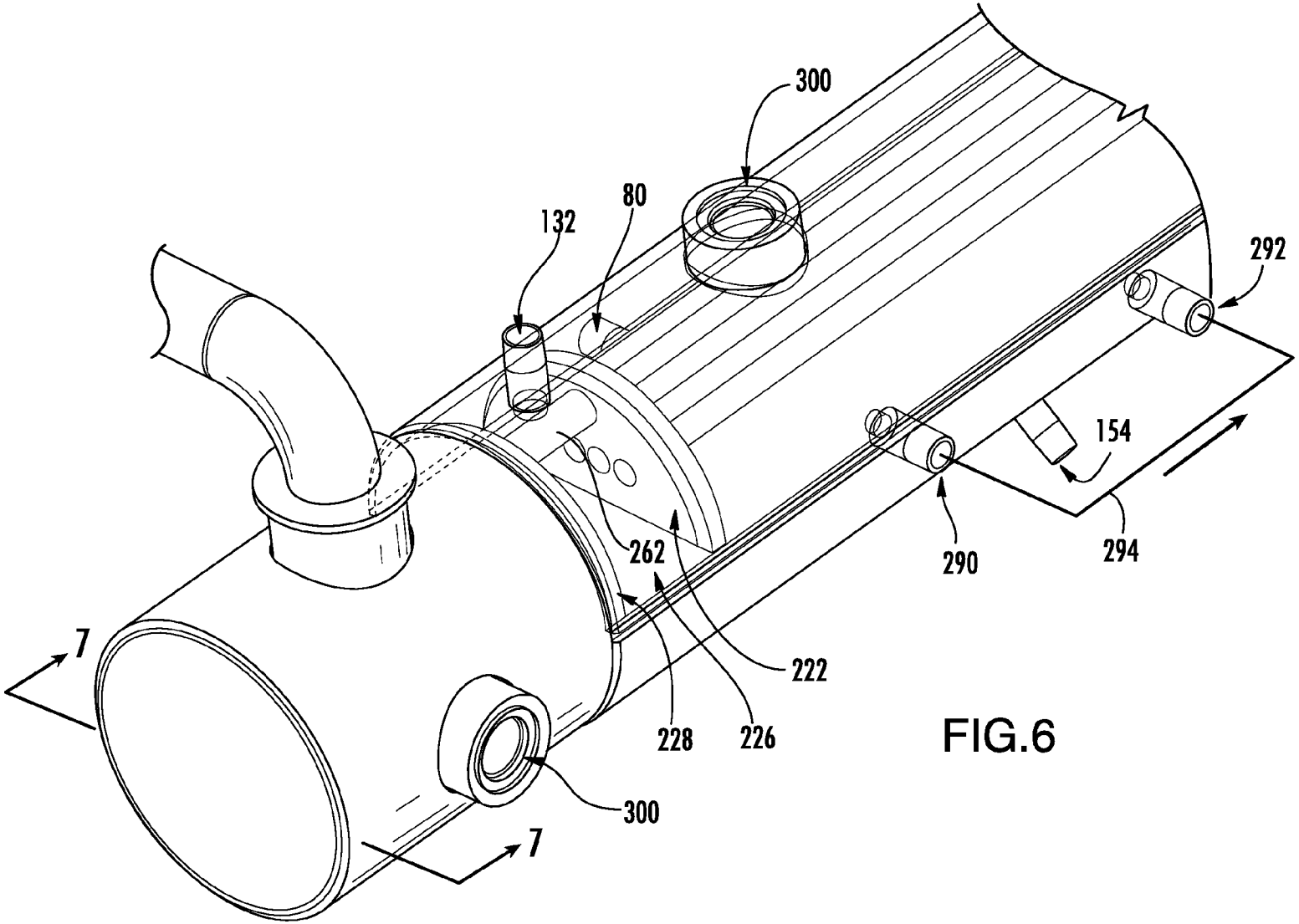
FIG. 6 is an enlarged partial view of the vaporizer of FIG. 3 with endplate removed.

FIG. 3 is a top view of the system 22 with the main upper portion 184-1 of the housing removed. FIG. 4 is a front view of the system of FIG. 3 and FIG. 5 is a back view of the system of FIG. 3.

Within the housing 180, a dividing wall 190 generally separates a vaporizer chamber or space 192 (FIG. 4) from a sump 194. The exemplary wall 190 extends generally transversely/horizontally so that the sump is immediately below the vaporizer chamber. The exemplary wall 190 comprises a metallic plate (e.g., carbon steel) welded along edges 190-1 and 190-2 to the sidewall and along respective ends 190-3 and 190-4 to an end wall 227 and a dividing wall 228 (FIG. 3). The wall 190 has an upper surface/face forming a lower boundary of the vaporizer chamber and a lower surface/face forming an upper boundary of the sump chamber. As is discussed below, in the exemplary implementation, an external conduit provides communication between the vaporizer chamber 192 and the sump 194. In alternative variations, one or more internal passageways may provide such considerations. One example of internal passageways involves replacing the dividing wall 190 with a similarly-positioned foraminate member. An exemplary foraminate member comprises a woven metallic mesh screen (e.g., stainless steel). Alternative foraminate members may be perforated or otherwise molded with associated pores/foramen/holes (not shown).

Within the housing 180, a gas conduit 220 is along the hot gas bypath flowpath 130 between the hot gas inlet 132 and the cool gas outlet 134. The gas conduit 220 passes through the vaporizer chamber 192. The exemplary gas conduit 220 comprises a plurality of tubes. The exemplary tubes extend from first ends secured at associated apertures in an upstream manifold plate 222 (e.g., rolled and expanded to mechanically interlock with the plate) to second ends similarly secured at corresponding apertures in a downstream manifold plate 224. An upstream manifold/plenum chamber 226 is between the plate 222 and an additional plate 228 toward the second end. The chamber 226 is in communication with the hot gas inlet 132. A downstream outlet/discharge plenum or manifold chamber 230 is between the plate 224 and the first endplate 186 and is open at the cool gas outlet 134. Thus, the gas bypass flowpath 130 passes from the inlet 132 into the chamber 226 and therefrom, through the tubes 220 to the chamber 230 and out the outlet 134. The exemplary plates 222 and 224 are semicircular essentially extending only along the vaporizer chamber 192 in the upper half of the housing and not the sump 194 in the lower half. The exemplary plate 228 is a full circle either in one piece or separate upper and lower halves for ease of assembly. The peripheries and lower radial chords of the semicircular plates may be beveled for ease of welding as may be the plate 190. For example, the beveled ends of the plate 190 may be welded to the chords of the plates 222 and 224.

Figure 7:
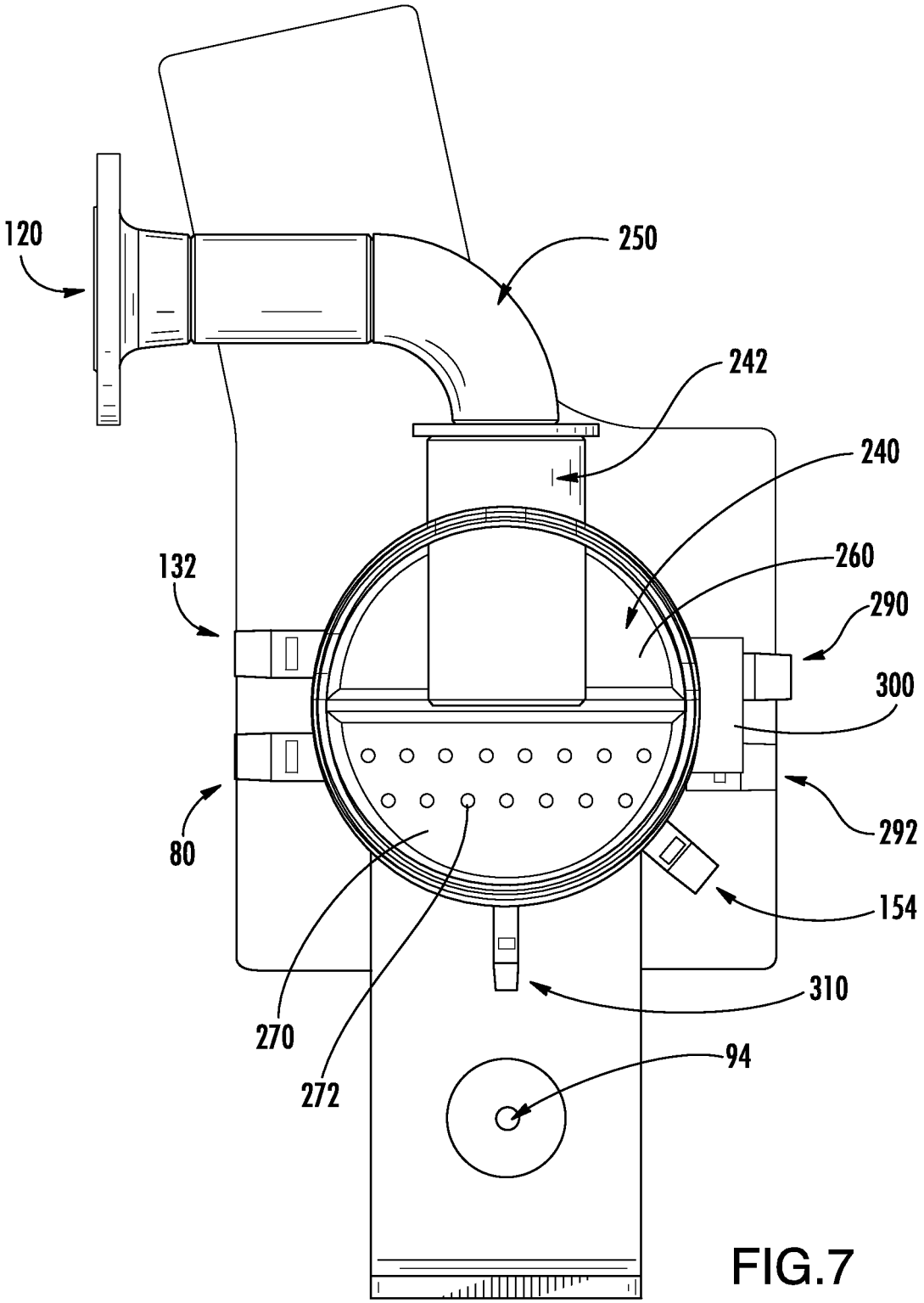
FIG. 7 is an end view of the vaporizer with endplate removed.

Opposite the plate 228 is a vapor outlet plenum/manifold chamber 240 (FIG. 7). A can-like mist eliminator 242 extends into the chamber 240 and has an exemplary lower end approximately along the horizontal centerplane 502 of the chamber 240 and housing. An upper end of the mist eliminator 242 connects to an outlet conduit assembly 250 extending to the first vapor outlet 120. The exemplary mist eliminator lower end is either fully or partially open (e.g., with a screen or a grating). The mist eliminator is filled with a collection media such as steel wool for separating liquid (oil droplets) from the outlet flow of vapor.

The exemplary plate 228 is formed as essentially a full circle with beveled periphery on each side and horizontal diametric radial bevels. These bevels facilitate welding to adjacent components. An upper portion (half) 260 of the plate 228 has an aperture at which an end portion of a conduit 262 (FIG. 3) is mounted (e.g., secured via rolling and expanding if it is copper or welded if it is carbon steel). The opposite end of the conduit 262 is similarly mounted at an aperture in the plate 222 along the chamber 192. The conduit 262 thus serves as a vapor outlet conduit from the chamber 192 to the chamber 240. The conduit 222 may also be filled with a mist collection media such as steel wool. Along an upper subportion of a lower portion (half) 270 (FIG. 7) of the plate 228 are an array of apertures 272 providing communication between the chamber 240 and the sump 194. This allows venting of vapor from the sump. The apertures 272 may be screened (not shown). the various plates may also be metallic (e.g., carbon steel).

FIG. 3 further shows a port/fitting 290 along a lower region of the housing main upper portion 184-1 and in communication with the vaporizer chamber and a port/fitting 292 along an upper region of the housing main lower portion 184-2 and in communication with the sump 194. A line 294 connects these two ports/fittings. Various figures also show a plurality of sight glasses 300 for viewing refrigerant and/or oil levels or other internal conditions and sensor ports 310 (e.g., providing connectors for sensors (not shown) for measuring various pressures or temperatures, or sampling compositions).

In operation, relatively oil-rich refrigerant is sampled from the evaporator shell via the skim line 74, and, controlled by an automatic valve 78, flows by gravity to a small heat exchanger formed by the tubes 220 and vaporizer chamber 192. Here, the refrigerant and oil mixture entering from the inlet 72 is brought into contact with the outside surface of heat exchanger tubes 220 to boil off the refrigerant, concentrating the oil prior to its return to the oil reservoir 70 via the sump chamber 194. The heat exchanger tubes 220 are fed via the chamber 226 with hot gas from the top of condenser or upstream thereof as the heat source, with the exit from the tubes being orificed (not shown) so that this gas is condensed at a constant pressure, maximizing the heat available for the boiling process. The cooled refrigerant (gas) is then returned from the chamber 230 to the evaporator shell via the line 140.

Vaporized refrigerant passes from the vaporizer chamber 192 through the conduit 262 (FIG. 3) and therefrom into the chamber 240. From the chamber 240 it passes out the outlet 120. An initial oil accumulation in the vaporizer chamber 192 may pass to the sump 194 via an appropriate passageway. An exemplary passageway is via the external line 294 through the port/fittings 290 and 292. The vaporizer chamber 192 and the sump 194 (and oil reservoir 70) are vented though respective ports 120 and 124 to the compressor suction line, and hence, to evaporator pressure.

In an implementation wherein the plate 190 is foraminate, oil may pass through the pores (not shown). However, the pores may be selected to be sufficiently small so that this is not the main route for oil from the vaporizer chamber 192 to the sump 194. Instead, the pores 196 provide a means for residual refrigerant vapor in the sump to pass into the vaporizer chamber. The main route for oil from the vaporizer chamber to the sump may be via an external or larger external or internal passageway.

By utilizing the oil vaporizer, high quality oil with satisfactory viscosity is reclaimed from the evaporator with little loss in chiller efficiency associated only with boiling the refrigerant liquid off the oil.

A small magnetic drive gear type oil pump 104 is used to provide positive pressure lubrication to the compressor bearings. This contrasts with an exemplary prior art oil reclaim system that has additional loss by utilizing hot gas bypass as driving force of oil return. Oil is fed to the required locations on the compressor. The oil pressure regulator valve 156 directs excessive oil back into the oil sump. Once oil feeding of compressor bearings is done, oil then travels with the compressor discharge gas, and it must be recovered from the refrigerant. Discharged bearing oil flows/drains through drain line 82 back to the sump 194 and therefrom to oil reservoir 70. The oil reservoir is kept at evaporator pressure via the sump.

The upstream position of the filter 100 allows it to protect the pump 104. Although shown schematically as a separate unit, this may be represented by an immersion-type filter at the outlet 94. The downstream position of the filter 106 eliminates return of any foreign particles to the compressor. An exemplary filter 100 is an immersion-type filter and is screwed into the reservoir 70. An exemplary filter 106 is an in-line type with a drain fitting (not shown; it can be used for drainage). Isolation valves 102 and 108 are used to isolate the pump 104 to replace or repair the pump 104 should there be a need.

The controller 400 may operate the heater 170 so as to maintain integrity (e.g., a sufficiently low refrigerant content while maintaining a sufficiently high viscosity) of oil returning to compressor throughout all phases of operation. Exemplary oil is an SW220 grade which is relatively viscous compared with other common grades.

In an exemplary control method, the controller may keep both stages off when the compressor is off. When the compressor is on (running), the heater may be controlled responsive to various sensed temperatures.

The controller may keep both stages off when any of several conditions are met. An exemplary two such conditions are: (a) condenser refrigerant temperature is greater than a threshold (e.g., 82° F. (28° C.)); and (b) the oil temperature is greater than a threshold (e.g., 152° F. (67° C.)).

The controller may engage a single stage (e.g., the heater first stage) when any of several conditions are present. This may be an exemplary: (a) the condenser refrigerant temperature is below a second threshold (e.g., 80° F. (27° C.)) and the motor speed is also below a given threshold (which will depend very highly on the particular motor and compressor; an exemplary threshold being 800 rpm with motor shutoff at 500 rpm); and (b) oil temp is below at least one of a fixed threshold (e.g., 90° F. (32° C.)) and a saturated suction temperature(SST)-dependent threshold (e.g. SST plus a fixed increment (e.g., an increment of 35° F.) (19° C.), more broadly, 20-40° F. (11-22° C.))). Thus, subject to override by the two-stage mode below, if either trigger (a) or (b) in this paragraph are satisfied, the single stage is engaged.

The controller may engage both stages when both conditions in the second trigger of single stage operation are present: oil temp is below at least one of the fixed threshold (e.g., 90° F. (32° C.)) and the saturated suction temperature (SST)-dependent threshold (e.g. SST plus the fixed increment (e.g., an increment of 35° F.) (19° C.), more broadly, 20-40° F. (11-22° C.))).

Pressure regulation by the valve 156 maintains a given pressure (e.g., 28 psid (193 kPad)) between oil sump and oil pump discharge; isolation valve 154 may be used for further adjustment or isolation.

An exemplary oil flow rate from the pump is approximately 0.23 gallons per minute (gpm (0.015 liters per second)) for a 500 ton (1,760 kW) chiller. This yields $4.6\times10^{-4}$ gpm/ton ($8.5\times10^{-6}$ liters/s/kW). More broadly, this may be characterized as $2\times10^{-4}$-$1\times10^{-3}$ gallon per minute per ton ($3.5\times10^{-6}$-$1.7\times10^{-5}$ liters/s/kW) (e.g., using the exemplary 500 ton (1,760 kW) chiller and exemplary flow rate ranges of 0.1-0.5 gpm (0.006-0.03 l/s) or less than $1\times10^{-3}$ gallon per minute per ton ($1.7\times10^{-5}$ liters/s/kW). Note the very small oil flow rates used on this chiller-nearly two orders of magnitude less than normally found on screw compressor chillers, a flow rate that would escape through normal oil separator. Oil is recovered from the refrigerant by means of an oil concentrating system operating at low side pressure.

Exemplary implementations may offer combinations of ease and low cost of manufacture, installation (e.g., piping and insulation). They also may furnish the compressor with an adequate amount of oil during colder/low load range of operation whereas an otherwise similarly sized baseline which would fail to supply a continuous feed of oil.

One or more embodiments have been described. Nevertheless, it will be understood that various modifications may be made. For example, when implemented via a modification of a baseline evaporator or in the context of a baseline chiller, details of the baseline may influence details of any particular implementation. Accordingly, other embodiments are within the scope of the following claims.

What is claimed is:

1. A system comprising:

a compressor;

a vaporizer comprising:

an inlet, an oil outlet, a vent, a primary flowpath extending from the inlet to the vent, a hot gas inlet, a cooled gas outlet, a gas flowpath extending from the hot gas inlet to the cooled gas outlet, a vaporizer chamber downstream of the inlet along the primary flowpath, a gas conduit along the gas flowpath in heat exchange relation with the primary flowpath, a sump below the vaporizer chamber, a two-stage immersion heater, a housing enclosing the sump and the vaporizer chamber, and a passageway from the vaporizer chamber to the sump;

an oil return line coupling the oil outlet to an oil return port of the compressor;

an oil pump along the oil return line;

a pressure reference branch conduit with a pressure reference branch flowpath branching from the oil return line and extending to a reference pressure port of the vaporizer; and a pressure regulating valve along the pressure reference branch conduit.

2. The system of claim 1 wherein:

the passageway is a conduit external to the housing.

3. The system of claim 1 wherein:

the sump is directly below the vaporizer chamber.

4. The system of claim 3 wherein:

the housing is a single circular cylindrical housing.

5. The system of claim 3 wherein:

the passageway comprises an external conduit extending between fittings along the housing.

6. The system of claim 1 wherein:

a plate at least partially forms a top of the sump and a bottom of the vaporizer chamber.

7. The system of claim 1 wherein:

the passageway is formed by a foraminate member.

8. The system of claim 1 wherein:

a metallic tubular main body of the housing contains the vaporizer chamber and the sump; and an oil reservoir is mounted to the main body below the sump.

9. The system of claim 1 wherein:

the heater has first and second elements in the sump.

10. The system of claim 9 wherein:

the heater is an electric heater.

11. The system of claim 9 wherein:

the gas conduit comprises a plurality of tubes with the gas flowpath passing through the tubes and the primary flowpath passing around the tubes.

12. A method for operating the system of claim 1 comprising:

passing a gas flow into the hot gas inlet and out the cooled gas outlet;

passing a refrigerant and oil flow into the inlet;

transferring heat from the gas flow to the refrigerant and oil flow; and separating the refrigerant and oil flow so that a refrigerant-rich portion exits the vent and an oil-rich portion exits the oil outlet.

13. The method of claim 12 wherein the method comprises, when the compressor is on:

running with both stages of the heater off when either condenser refrigerant temperature is greater than a first threshold condenser refrigerant temperature or oil temperature is greater than a first oil temperature threshold;

running with only one stage on when the condenser refrigerant temperature is not greater than the first threshold condenser refrigerant temperature and oil temperature is not greater than the first oil temperature threshold and either:

condenser refrigerant temperature is less than a second threshold condenser refrigerant temperature which is lower than the first threshold condenser refrigerant temperature and motor speed is lower than a speed threshold; or oil temperature is either less than a second oil temperature threshold, lower than the first oil temperature threshold, or less than the saturated suction temperature plus a predefined increment; and running with both stages on:

when the condenser refrigerant temperature is not greater than the first threshold condenser refrigerant temperature and oil temperature is not greater than the first oil temperature threshold and the oil temperature is both less than the second oil temperature threshold and less than the saturated suction temperature plus the predefined increment.

14. The system of claim 1 further comprising:

a mist eliminator for separating liquid from a flow out the vent.

15. The system of claim 1 wherein:

the gas conduit comprises a plurality of tubes with the gas flowpath passing through the tubes and the primary flowpath passing around the tubes.

16. The system of claim 1 wherein:

the pressure reference branch conduit branches from the oil return line downstream of the oil pump.

* * * * *